US005718530A

United States Patent [19]

Tibbetts

[11] Patent Number: 5,718,530

[45] Date of Patent: Feb. 17, 1998

[54] BINDER ASSEMBLY

[76] Inventor: Paul R. Tibbetts, 184 Breckenridge St., Palmer, Mass. 01069

[21] Appl. No.: 568,908

[22] Filed: Dec. 7, 1995

[51] Int. Cl.[6] ..... B42F 13/00

[52] U.S. Cl. ..... 402/73; 402/75; 402/70

[58] Field of Search ..... 402/73, 70, 75, 402/80 R; 281/29, 34, 36, 37

[56] References Cited

U.S. PATENT DOCUMENTS

| | | | |
|---|---|---|---|
| 1,708,811 | 4/1929 | Von Auw | 402/73 X |
| 1,841,575 | 1/1932 | Dorsch | 402/73 X |
| 3,262,454 | 7/1966 | Shillinger . | |
| 3,262,455 | 7/1966 | Shillinger . | |
| 4,681,474 | 7/1987 | Wiberg | 402/75 |
| 4,722,628 | 2/1988 | Rager | 402/75 |
| 5,120,149 | 6/1992 | Smith | 402/75 |
| 5,154,528 | 10/1992 | Cananzey et al. | 402/19 |
| 5,158,387 | 10/1992 | Davies | 402/73 X |
| 5,160,209 | 11/1992 | Schuessler | 402/75 |
| 5,445,468 | 8/1995 | Pacione | 402/73 X |
| 5,509,745 | 4/1996 | Hegarty | 402/73 X |
| 5,575,504 | 11/1996 | Wagner | 402/73 X |

*Primary Examiner*—Frances Han
*Attorney, Agent, or Firm*—Robert A. Seemann

[57] ABSTRACT

A method of assembling a sheet binder mechanism to a binder cover includes making holes in a board in predetermined alignment with a plurality of fastening means on the binder mechanism, inserting bracket means in the holes preferably so that the board retainably holds the bracket means, attaching the board to the binder cover, attaching a binder cover liner to the board on the side of the board that is away from the attachment of the board to the binder cover, and attaching the sheet binder mechanism to the binder cover by driving a thread making fastener into the bracket means.

8 Claims, 4 Drawing Sheets

BINDER ASSEMBLY

BACKGROUND OF THE INVENTION

1. Field of the Invention

This invention pertains to attachment of a sheet binder mechanism to a binder cover, such as attachment of a looseleaf ring binder mechanism to a back cover board, or to a hinged looseleaf cover.

2. Description of the Prior Art

The art is replete with patents for assemblies and methods which are designed to provide reversible fastening of releasably engaging sheet binder mechanisms to a binder cover simply, inexpensively, and with the fastening means concealed from the binder cover.

For example, U.S. Pat. No. 3,262,454 patented Jul. 26, 1966 by G. P. Shillinger describes a resilient plastic longitudinal strip which fits against the back of the binder cover and has a pair of projections that extend through openings in the binder cover and then through holes in the longitudinal frame of the binder mechanism. In one arrangement, each projection is temporarily locked into the frame by sliding the strip in one direction longitudinally until a head on the projection fits in a recess in the inside facing side of the frame associated with an adjacent opening through the frame.

In another arrangement the projection is temporarily locked in to the frame by a radially slotted washer that engages radial slots in the projection just below the front of the projection and fits into a recess in the inside facing side of the frame surrounding the opening.

In both arrangements, the longitudinal strip is concave so that the assembly may be squeezed while the lock is made, and relaxed so that the projection head or the slotted washer fully seat in the recess.

U.S. Pat. No. 4,681,474, patented Jul. 21, 1987 by O. Wiberg describes a ring mechanism of a ring binder for punched documents being removably attached to the cover of a ring binder by a hook and loop fastener.

One part of the hook and loop fastener is on the ring mechanism and the other part is on the cover, so that the ring mechanism can be attached and removed from the cover by pressing it on the cover, and peeling it off from the cover by lifting from one end.

One example of a hook and loop fastener is Velcro™. Several ring mechanisms may be attached to, removed from, and interchanged upon the same spine by providing rows of the hook or loop on the spine inside the binder cover ready to accommodate the mating hook or loop on each of a variety of ring mechanisms.

The hook and loop fastener does not require precise alignment of a ring mechanism with the spine, as the hook and loop fastener can take hold with the ring mechanism angled across the rows.

U.S. Pat. No. 4,722,628 patented Feb. 2, 1988 by D. C. Rager describes a binder in which the spine comprises a longitudinal pocket made by sealing to one another the outer cover and an inner liner of the binder, along a pair of parallel strips which define the pocket.

A hollow, longitudinal, rectangular spine having a longitudinal center rib is inserted into the pocket. The looseleaf ring mechanism comprising an elongated supporting plate and snap rings is permanently attached to the binder by circumferentially grooved or ribbed metal rivets which are inserted through openings in the supporting plate and into the longitudinal center rib, and ultrasonically welded into the center rib. The rivet is concealed from the outer side of the binder.

U.S. Pat. No. 5,160,209, patented Nov. 3, 1992 by R. F. Schuessler describes a pair of anchor plates which attaches a paper retaining binder mechanism to the spine of a binder cover. The anchor plate has on one face a plurality of integrally formed prongs which pierce the inward facing surface of the spine and permanently attach the anchor plate to the spine when the anchor plate is pressed against the spine. The opposite face of the anchor plate has a post which extends generally normal to the opposite face.

The paper retaining binder mechanism has openings which receive the posts. The post extends through the opening and is flared over the front of the binder mechanism thereby permanently holding the binder mechanism to the spine. This arrangement conceals from the outer side of the binder, the means for fastening the paper retaining binder to the binder cover.

SUMMARY OF THE INVENTION

It is one object of the invention to provide an assembly for attaching a sheet binder mechanism to a binder cover in which the attachment means is concealed from the back side or the outer side of the binder cover.

It is another object of the invention that the attachment of the sheet binder mechanism to the binder cover is reversible, that is, detachable.

It is another object that a binder cover may be prepared to attach a predetermined variety of sizes and kinds of sheet binder mechanisms.

It is another object that the attachment of the sheet binder mechanism to the binder cover is not limited to a precise location on the binder cover.

It is another object that the binder cover need not be prepared for attachment of the sheet binder mechanism such as by drilling or punching of the binder cover.

It is another object that the attachment means comprises thread forming screws.

Other objects and advantages of the invention will become apparent to one reading the ensuing description of the invention.

A sheet binder assembly includes a first sheet binder mechanism that includes first attachment means and second attachment means for mounting the sheet binder mechanism on an item, the second attachment means being spaced from the first attachment means on the binder mechanism, a binder cover, a locator board, and first bracket means and second bracket means mounted on the locator board and spaced from the first bracket means so that the first and second bracket means are in alignment with the first and second attachment means respectively when the sheet binder mechanism is mounted on the binder cover.

The locator board is fastened to the binder cover.

The first bracket means includes means for preventing movement of the first bracket means completely through the locator board.

The locator board includes a first opening through the locator board, and the first bracket means extends into the first opening.

The first bracket means may extend between the locator board and the binder cover, and may comprise means for gripping the locator board so that the bracket is prevented from rotating in the first opening by the means for gripping.

The locator board may include a third bracket means mounted on the locator board so that the third bracket means is in alignment with a third attachment means on a second sheet binder mechanism that includes a third attachment means for mounting the second sheet binder mechanism on an item, when the second sheet binder mechanism is mounted on the binder cover.

A method of assembling a sheet binder mechanism to a binder cover includes making holes in a board in predetermined alignment with a plurality of fastening means on the binder mechanism, inserting bracket means in the holes preferably so that the board retainably holds the bracket means, attaching the board to the binder cover, attaching a binder cover liner to the board on the side of the board that is away from the attachment of the board to the binder cover, and attaching the sheet binder mechanism to the binder cover by driving a thread making fastener into the bracket means.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
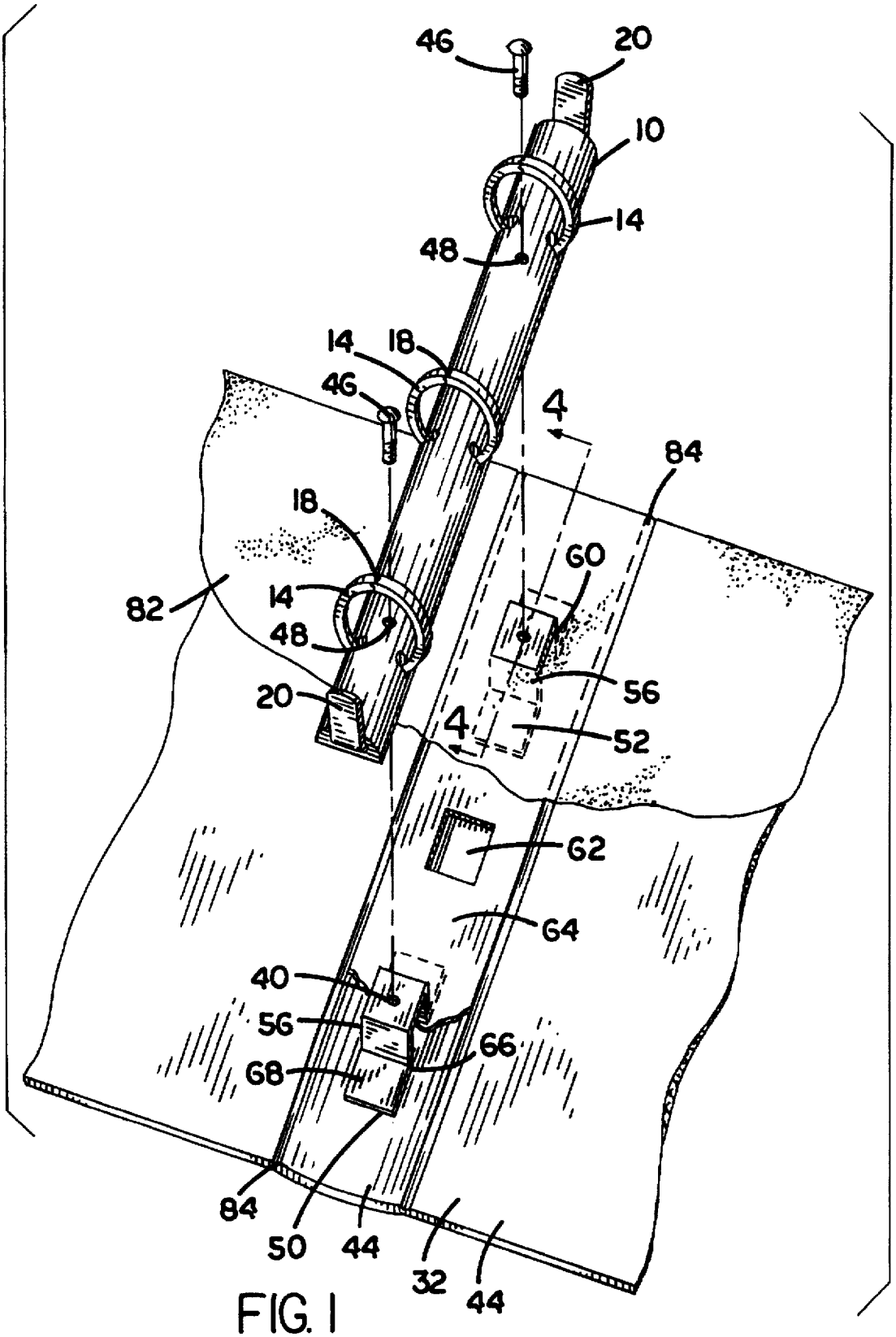
FIG. 1 is a perspective partially exploded view of a binder assembly of the present invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIG. 1, sheet binder mechanism 10 of binder assembly 12 is a standard three ring releasably engaging binder mechanism in which rings 14 may be snapped apart at serpentine engagement faces 18 by pressing on finger levers 20, to permit loading the rings with three hole paper. The rings are then closed by squeezing them together by finger pressure.

Figure 2:
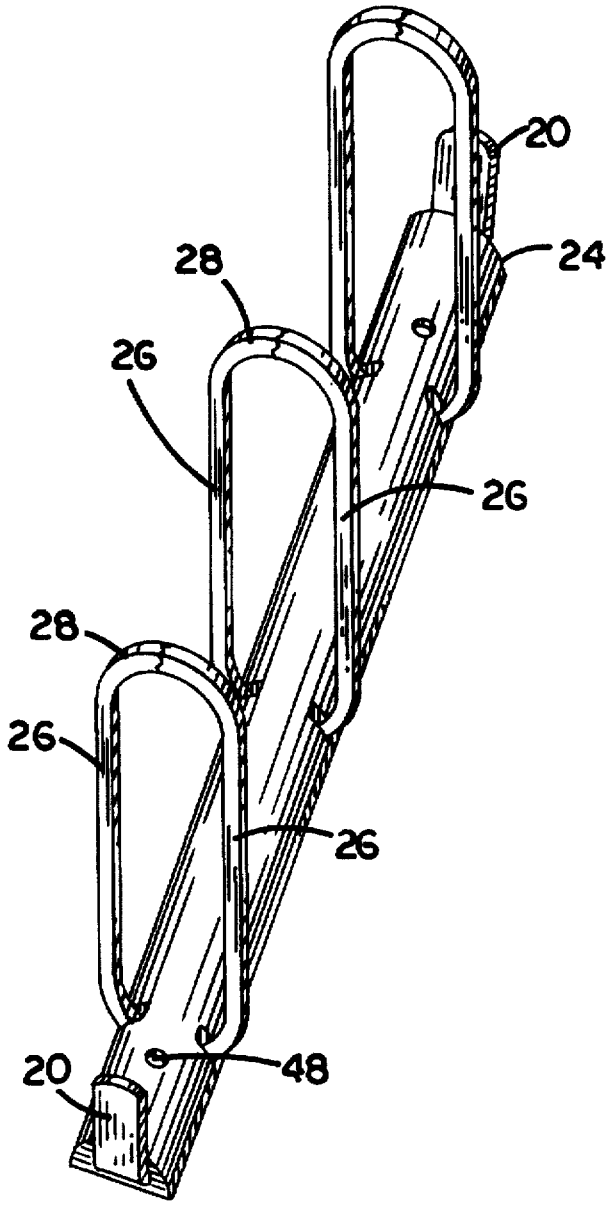
FIG. 2 is a perspective view of a releasably engaging sheet binder mechanism.

In FIG. 2, releasably engaging sheet binder mechanism 24 is a larger capacity version of mechanism 10, able to carry more than three times as much paper due to straight, long, arms 26 of snap rings 28.

Figure 3:
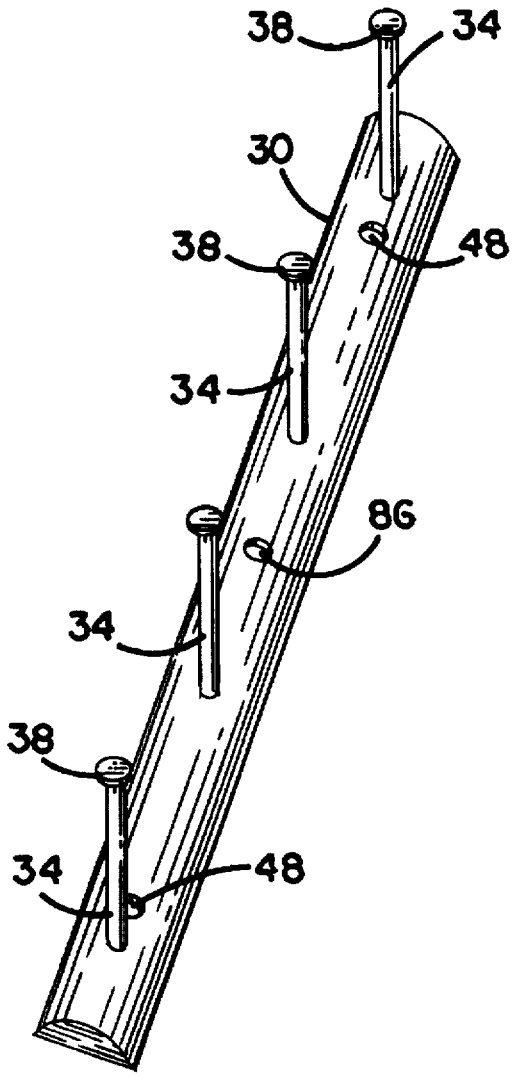
FIG. 3 is a perspective view of a sheet binder mechanism.

In FIG. 3, sheet binder mechanism 30 is designed to hold perforated sheets on binder posts 34. In order to mount the sheets permanently on mechanism 30, such as with calendar pages which can only be removed by tearing each sheet laterally from the binder posts, the posts are topped by permanently fused on caps 38 after the sheets are loaded on the posts.

Referring to FIGS. 1–8, sheet binder mechanism 10 is attached to front side, or inner side 32 of folding binder cover 44 by fasteners 46 which preferably are removable. For example fasteners 46 shown are thread rolling self tapping screws. Screws 46 pass down through attachment openings 48, which are preferably eyelets, in binder mechanism 10, and create threads in openings 40 in brackets 50, 52.

In another preferred arrangement, openings 40 may be threaded in advance, and receive appropriately threaded fasteners. In another arrangement, the fastener may be a snap-fit insert to the bracket.

An attachment means for mounting the binder mechanism on the binder cover comprises, for example, opening or eyelet 48, a threaded fastener through the opening, or a fastener on the binder mechanism, for engaging the aligned bracket for fastening the binder mechanism to the bracket.

Binder cover 44 is shown as a folding cover having hinges 84, however, it should be understood that the term "binder cover" also includes a stiff back board, a hingeless board, a flexible board, or similar practical support for a sheet binder mechanism. The "front side" of the binder cover is the side upon which the binder mechanism is fastened.

In the assembly of the binder mechanism to the binder cover, head 56 closely fits opening 60 in locator board 64. Preferably the head of the bracket is not uniformly round, but has a shape that prevents rotation of the head within the closely fit opening in the locator board. For example, the head may be triangular, D-shaped, or circular with an irregular circumference.

Figure 6:
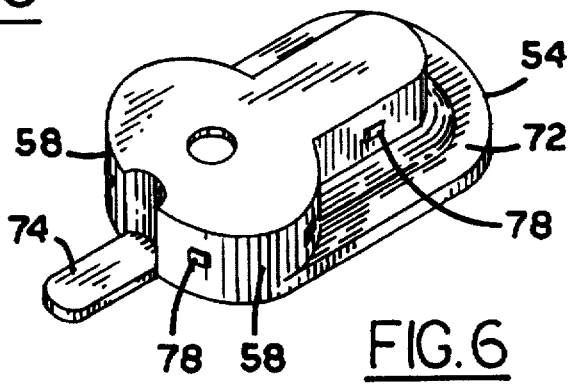
FIG. 6 is a perspective view of a bracket of the invention.

In FIG. 6, bracket 54 head 58 is oblong. The irregular shapes prevent rotation of a bracket by a fastener when the fastener is installed in or removed from the bracket.

Preferably the head includes space 36 for the fastener so that the fastener does not penetrate through binder cover 44.

The fastener and bracket cannot be seen from the back side of a generally flat non-foldable binder cover, or from the outer side 22 of a folding binder cover such as the one shown in FIG. 1.

Figure 7:
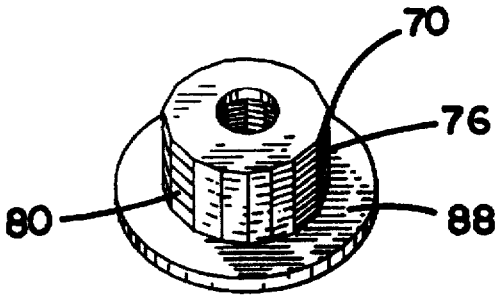
FIG. 7 is a perspective view of a bracket of the invention.
Figure 8:
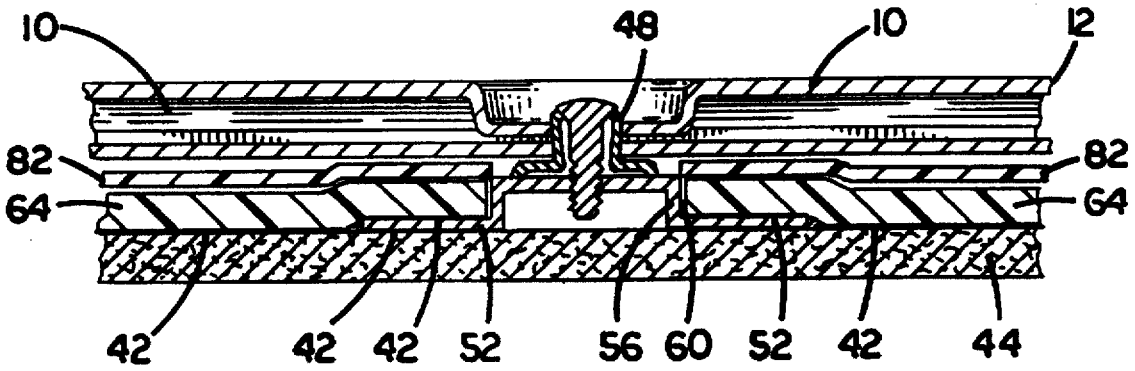
FIG. 8 is a side, section view of the assembly of FIG. 1 assembled, viewed along 4—4.

In FIG. 7, bracket 70 head 76 has serrated wall 80 which grips the edge of a location board opening and prevents rotation of the bracket in the opening.

Head 56 extends above base 66. Laterally extending foot 68 is captured between locator board 64 and binder cover 44, and prevented from vertical movement 98 past board 64 and cover 44 when locator board 64 is held against cover 44. Foot 68 extends laterally 94 beyond edge 96 of opening 60 thereby preventing passage of the bracket completely through opening 60.

The locator board is fastened to the cover by glue 42 or other fastening means. For additional strength, foot 68 may be fastened, preferably by glue, to the back cover 44, the locator board, or both. The foot may be any shape, for example foot 68, 72, 74, and 88, which anchors the bracket between a locator board and a binder cover.

Opening 60 aligns the head of each bracket in predetermined relationship with the binder mechanism so that each eyelet 48 lines up over an appropriate opening 40.

A locator board may have a plurality of openings, more than are required for alignment with the eyelets of a particular binder mechanism, such as additional opening 62, so that one locator board can be used to align brackets for different binder mechanisms having different distances between eyelets.

Figure 4:
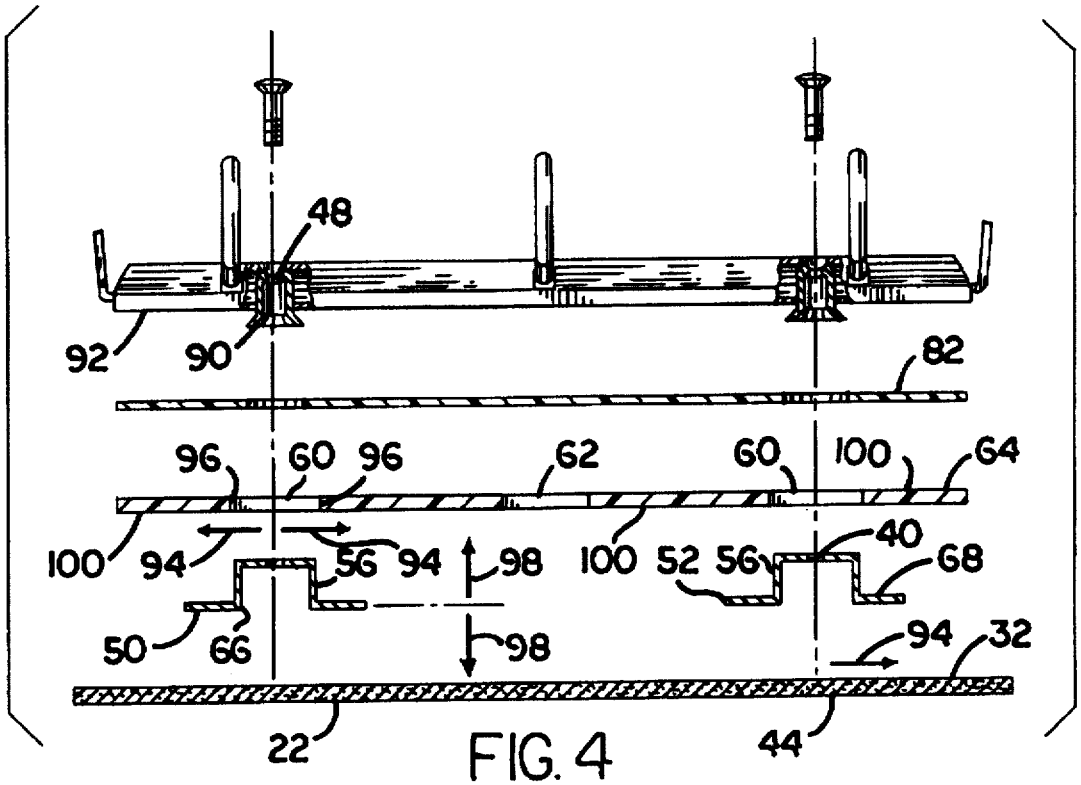
FIG. 4 is an exploded side view of the assembly of FIG. 1
Figure 5:
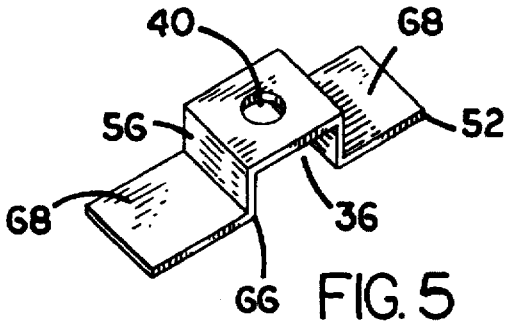
FIG. 5 is a perspective view of a bracket of the invention.

The locator board may be cardboard, particle board, plastic, or other material having sufficient stiffness and body to hold the brackets in predetermined alignment. As shown in FIG. 4, back 100 of locator board 64 is rearwardly accessible in the area of hole 60 to access the hole directly from the back of the board.

A user may find the need to change binder mechanisms while retaining the same binder cover. For example the user may choose to replace releasably engaging binder mechanism 10 with larger capacity releasably engaging binder mechanism 24, or with permanent holding binder mechanism 30. Binder mechanism 30 may be attached only to a single bracket, not shown, which is added in advance to opening 62, by way of a fastener through opening 86 into the bracket. Binder mechanism 30 may then be rotated 90 degrees to the hinge for display purposes after a hinged binder cover is opened.

Preferably the fit between a bracket head and the locator board opening is such that the bracket is retainably held by the locator board. This permits handling the locator board without the brackets falling out of the locator board. For example, the fit may be a press fit between the locator board opening and some part of the bracket, or a bump 78, a depression in the head, or integrally formed prongs, may grippingly engage the locator board.

Binder cover 44 liner 82 covers locator board 64, hinge 84, and binder cover 44 for aesthetic value. It may also be used to provide waterproofing and impart greater tear resistance to the binder cover.

In assembling a binder assembly according to the invention, a preferred method includes installing brackets into openings in the locator board so that the brackets align with predetermined eyelet spacing and arrangements of different binder mechanisms which can thereby be attached to brackets.

For speed of assembly and accuracy, brackets are designed to stay in the locator board by the action of being pressed into the board.

The locator board containing the pressed-in brackets is fastened to the front side of the binder cover, preferably by a fast acting glue which preferably also glues the foot of the bracket to one or both of the locator board and the binder cover.

A sheet binder mechanism is selected according to use desired, and that has openings which align with certain of the brackets in the locator board. A fastener is inserted through an opening in the sheet binder mechanism and is fastened to the bracket that is in alignment with the opening. This is repeated with the other openings in the sheet binder mechanism and the brackets which are in respective alignment with the other openings.

For ease of alignment of a sheet binder mechanism with brackets in the locator board, the locator board with the binder cover, and the liner with the binder cover, a frame or jig may be provided for manual or automatic assembly.

For ease of alignment of a replacement sheet binder mechanism with brackets in the locator board, for installation by a user, bottoms 90 of openings 48, or bottom 92 of the sheet binder mechanism may be shaped to engage the heads of the brackets or a part of the locator board so that the user receives tactile indication of alignment.

The liner is fastened by glue or other fastening means over the binder cover and locator board preferably before the sheet binder mechanism is fastened to the brackets, but may be installed after the binder mechanism is fastened to the brackets.

Openings may be made through the liner in the same pattern as openings in the locator board, but this is not generally necessary since fasteners forced through the liner will automatically align with the respective brackets in the locator board.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A sheet binder assembly comprising:

a sheet binder mechanism comprising first attachment means for mounting said sheet binder mechanism on an item, and second attachment means for mounting said sheet binder mechanism on the item, said second attachment means being spaced a predetermined distance on said sheet binder mechanism from said first attachment means, an outer cover having a front and a back, a locator board having a front and a rearwardly accessible back and configured for mounting on the front of said outer cover, a first discrete bracket having a front, a back, a height from the front to the back, and a laterally extending portion, a second discrete bracket having a front, a back, a height from the front to the back, and a laterally extending portion, said locator board comprising a first hole through said locator board and a second hole through said locator board spaced on said locator board from said first hole, said first discrete bracket being sized and configured to fit in said first hole when inserted in said first hole from the rearwardly accessible back of the locator board and have the laterally extending portion of said first discrete bracket extend behind the board adjacent to the hole independently of said second discrete bracket, and said second discrete bracket being sized and configured to fit in said second hole when inserted in said second hole from the rearwardly accessible back of the locator board independently of said first discrete bracket, said first and second holes being spaced a predetermined distance from one another such that the first and second discrete brackets line up with the predetermined spaced first and second attachment means when the brackets are in the holes and the sheet binder mechanism is mounted on the front of the locator board.

2. The assembly of claim 1, further comprising:

said first locator board being mounted on said outer cover, said first bracket means extending between said locator board and said outer cover in contact with said locator board and outer cover independently of said second bracket.

3. The assembly of claim 1, further comprising:

said first opening having an inner wall, said first bracket being sized and configured to grip said inner wall so that said first bracket is prevented from rotating in said first hole and from falling out of said first hole.

4. The assembly of claim 3, further comprising:

said first bracket comprising means for preventing movement of said bracket completely through said locator board.

5. A binder assembly for a sheet binder mechanism comprising first attachment means for mounting said sheet binder mechanism on an item and second attachment means for mounting said sheet binder mechanism on the item, said second attachment means being spaced a predetermined distance on said sheet binder mechanism from said first attachment means, said binder assembly comprising:

an outer cover having a front and a back, a locator board having a front and a rearwardly accessible back and configured for mounting on the front of said outer cover, a first discrete bracket having a front, a back, a height from the front to the back, and a laterally extending portion, a second discrete bracket having a front, a back, a height from the front to the back, and a laterally extending portion, said locator board comprising a first hole through said locator board and a second hole through said locator board spaced on said locator board from said first hole, said first discrete bracket being sized and configured to fit in said first hole when inserted in said first hole from the rearwardly accessible back of the locator board and have the laterally extending portion of said first discrete bracket extend behind the board adjacent to the hole independently of said second discrete bracket, and said second discrete bracket being sized and configured to fit in said second hole when inserted in said second hole from the rearwardly accessible back of the locator board independently of said first discrete bracket, said first and second holes being spaced a predetermined distance from one another such that the first and second discrete brackets line up with the predetermined spaced first and second attachment means when the brackets are in the holes and the sheet binder mechanism is mounted on the front of the locator board.

6. The assembly of claim 5, further comprising:

said first opening having an inner wall, said first bracket being sized and configured to grip said inner wall so that said first bracket is prevented from rotating in said first hole and from falling out of said first hole.

7. The assembly of claim 6 wherein said first discrete bracket is generally U-shaped in cross section, the laterally extending portion extending from an arm of the U.

8. A method of making a binder for assembly with a sheet binder mechanism comprising first attachment means for mounting said sheet binder mechanism on an item and second attachment means for mounting said sheet binder mechanism on the item, said second attachment means being spaced a predetermined distance on said sheet binder mechanism from said first attachment means, said method comprising making a first hole through a board having a front and a rearwardly accessible back and configured for mounting on the front of an outer cover for the binder, and making a second hole through the board spaced on the board from the first hole, making a first discrete bracket sized and configured to fit in the first hole with a portion of the first discrete bracket laterally extending behind the board adjacent to the first hole when the first discrete bracket is inserted in the first hole from the rearwardly accessible back of the board, making a second discrete bracket sized and configured to fit in the second hole with a portion of the second discrete bracket laterally extending behind the board adjacent to the second hole when the second discrete bracket is inserted in the second hole from the rearwardly accessible back of the board, in spacing the first and second holes from one another, make the spacing so that the first and second discrete brackets line up with the predetermined spaced first and second attachment means when the brackets are in the holes and the sheet binder mechanism is mounted on the front of the board, next, insert the first discrete bracket in the first hole from the back of the board, and insert the second discrete bracket in the second hole from the back of the board, next, mount the board with the discrete brackets installed within the board, on the outer cover for the binder and mount the sheet binder mechanism on the front of the board.

* * * * *